US007392553B2

(12) United States Patent
Uhl et al.

(10) Patent No.: US 7,392,553 B2
(45) Date of Patent: Jul. 1, 2008

(54) OVERFLOW DRAIN ASSEMBLY FOR SANITARY VESSELS

(75) Inventors: Gary Uhl, Fair Haven, NJ (US); Vincent F. Rotella, Colonia, NJ (US)

(73) Assignee: AS IP Holdco, LLC, Boston, MA (US)

( * ) Notice: Subject to any disclaimer, the term of this patent is extended or adjusted under 35 U.S.C. 154(b) by 512 days.

(21) Appl. No.: 11/221,682

(22) Filed: Sep. 8, 2005

(65) Prior Publication Data

US 2007/0050907 A1 Mar. 8, 2007

(51) Int. Cl.
*E03C 1/22* (2006.01)

(52) U.S. Cl. ..... 4/680; 4/694

(58) Field of Classification Search ..... 4/507, 4/541.1, 680, 694; 210/167.1
See application file for complete search history.

(56) References Cited

U.S. PATENT DOCUMENTS 1,784,641 A * 12/1930 Oldfield ..... 4/651
4,777,676 A * 10/1988 Ericson ..... 4/619
4,920,582 A 5/1990 Alker
6,295,664 B2 * 10/2001 Fritz et al. ..... 4/679
6,681,420 B1 1/2004 Ball
7,007,319 B2 * 3/2006 Dunnett et al. ..... 4/680
7,237,280 B1 * 7/2007 Holden et al. ..... 4/680

* cited by examiner

*Primary Examiner*—Charles E. Phillips
(74) *Attorney, Agent, or Firm*—Matthew K. Ryan; Frommer Lawrence & Haug

(57) ABSTRACT

The present invention provides an overflow drain assembly for a sanitary vessel, wherein the vessel includes a bottom surface and at least one side surface depending therefrom, such that the surfaces together define a reservoir for receipt and storage of fluid thereby and at least one ledge is provided along at least a portion of at least one vessel side surface. The overflow drain assembly comprises a fastening plate having an envelope with a top surface and a bottom surface defining a generally planar body that lies proximate the vessel ledge, and a tarp portion depending curvilinearly therefrom. The tarp portion has a generally planar bottom surface disposed adjacent at least a portion of at least one vessel side surface so as to define a fluid egress therebetween for delivery of fluid from the vessel reservoir to a waste conduit in fluid communication therewith. A port adapter establishes the fluid communication between the vessel reservoir and the waste conduit, and a retaining means is provided for retaining the fastening plate to the vessel. At least one platform member may depend downwardly from the envelope bottom surface for elevation thereof relative to the vessel ledge. The envelope top surface may include at least one index defined thereon to indicate a location of the waste conduit relative to the fastening plate. The present invention also provides a system for preventing fluid overflow from a sanitary vessel.

9 Claims, 5 Drawing Sheets

OVERFLOW DRAIN ASSEMBLY FOR SANITARY VESSELS

FIELD OF THE INVENTION

The present invention is directed to an overflow drain assembly for sanitary vessels such as bathing and soaking tubs (including whirlpool and hydromassage tubs), lavatories and sinks. More particularly, the present invention provides an overflow drain assembly that directly drains fluid from the vessel reservoir and enables direct, straight line access to a downstream drain waste system in communication therewith. In this configuration, the present inventive drain assembly combines simple installation and maintenance features within existing plumbing structure and simultaneously provides enhanced soaking capability for optimal bathing experiences.

BACKGROUND OF THE INVENTION

Conventional sanitary vessels such as bathtubs, whirlpool tubs, hydromassage tubs, immersion vessels and related products (collectively "bathing vessels") are ubiquitously installed in residences, hotels, hospitals, therapeutic treatment centers and like facilities. Builders and contractors install such vessels in communication with each of a main drain pipe that is in fluid communication with a drain port disposed at a bottom surface of the vessel and a waste overflow pipe in fluid communication with an overflow port disposed in a sidewall of such vessel. Accurate installation in this configuration is essential to the proper function of the bathing vessel in concert with its associated fluid conduits.

It is well known, however, that bathing vessels continue to consume much time and effort during installation and maintenance, in spite of prior efforts to simplify both the installation assembly configuration and the maintenance thereof (see U.S. Pat. No. 4,920,582 to Alker and U.S. Pat. No. 6,681,420 to Ball). Bathing vessels must be placed in communication with both the main drain pipe and the waste overflow pipe, and conventional installations have achieved this by providing a vertically disposed overflow drain assembly in communication with the vessel's overflow port. Such configuration not only promotes the accumulation of deleterious debris in the waste overflow pipe but also invokes significant time and effort to execute proper maintenance thereof. In addition, such an overflow device inherently undermines the bather's enjoyment by eliminating much of the soaking depth in which the bather may relax.

It is therefore desirable to provide an overflow drain assembly that eases the difficulty inherent in the installation and maintenance of the bathing vessel and simultaneously supply beneficial soaking capabilities to the bather. Such an assembly would possess both functional and aesthetic benefits that are adaptable in the design of bathing vessels, lavatories, sinks, fountains, spas and other sanitary devices requiring the transport of overflow fluid therefrom.

SUMMARY OF THE INVENTION

It is an advantage of the present invention to provide an overflow drain assembly that provides direct access to a waste overflow pipe in fluid communication therewith.

It is another advantage of the present invention to provide an aesthetically pleasing overflow drain assembly that provides a functional alternative to conventional overflow assemblies disposed on the vertical wall of a bathing vessel near the overflow port. Such an overflow drain assembly may be implemented to either minimize or accentuate the appearance of the overflow port as desired.

It is still another advantage of the present invention to provide an overflow drain assembly that inherently supplies deeper soaking capability to the bather. The overflow drain assembly of the present invention allows a substantially increased volume of water to remain in the bathing vessel before the overflow is effected.

In the attainment of these and other advantages, the present invention provides an overflow drain assembly for a sanitary vessel, wherein the vessel includes a bottom surface and at least one side surface depending therefrom, such that the surfaces together define a reservoir for receipt and storage of fluid thereby and at least one ledge is provided along at least a portion of at least one vessel side surface. The overflow drain assembly comprises a fastening plate having an envelope with a top surface and a bottom surface defining a generally planar body that lies proximate the vessel ledge, and a tarp portion depending curvilinearly therefrom. The tarp portion has a generally planar bottom surface disposed adjacent at least a portion of at least one vessel side surface so as to define a fluid egress therebetween for delivery of fluid from the vessel reservoir to a waste conduit in fluid communication therewith. A port adapter establishes the fluid communication between the vessel reservoir and the waste conduit, and a retaining means is provided for retaining the fastening plate to the vessel. At least one platform member may depend downwardly from the envelope bottom surface for elevation thereof relative to the vessel ledge. The envelope top surface may include at least one index defined thereon to indicate a location of the waste conduit relative to the fastening plate.

The present invention also provides a system for preventing fluid overflow from a sanitary vessel. The system includes a sanitary vessel having a bottom surface and at least one side surface depending therefrom wherein such surfaces define a reservoir for receipt and storage of fluid in the vessel. At least one ledge is defined along at least a portion of at least one vessel side surface, and a drain is provided at or near the vessel bottom surface for delivery of fluid from the vessel to a first waste conduit in fluid communication therewith. An overflow drain assembly in operable communication with the sanitary vessel includes a fastening plate as described previously wherein a fluid egress defined relative thereto effects delivery of fluid from the vessel reservoir to a second waste conduit in fluid communication therewith. Desirably, the vessel ledge is disposed generally normally relative to the at least one vessel side surface and includes at least one waste overflow port that overlies an opening of the second waste conduit. The at least one waste overflow port and second conduit opening are disposed generally horizontally relative to the at least one vessel side surface, thereby ensuring direct access to the second waste conduit and efficient maintenance thereof and also establishing a deep soaking level at the onset of a bathing session. The fastening plate may include a receptacle in fluid communication with the second waste conduit for egress of fluent of effluents from any objects (i.e., bath toys, sponges, jewelry, cleaning accessories, etc.) placed within such receptacle.

Various other advantages and features of the present invention will become readily apparent from the ensuing detailed description.

DETAILED DESCRIPTION OF THE PREFERRED EMBODIMENTS

Figure 4:
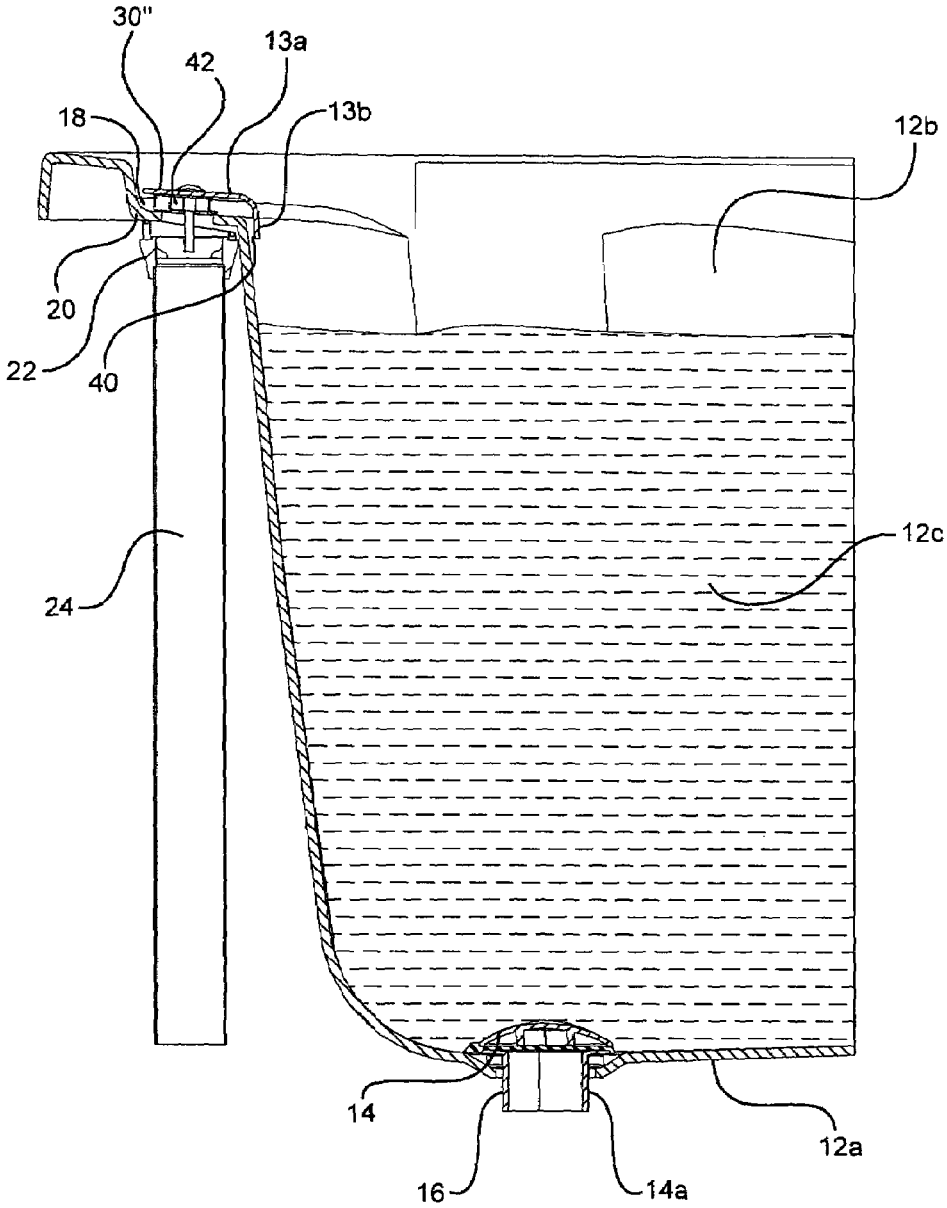
FIG. 4 is sectional view of a bathing vessel that incorporates an overflow drain assembly of the present invention during use.
Figure 5:
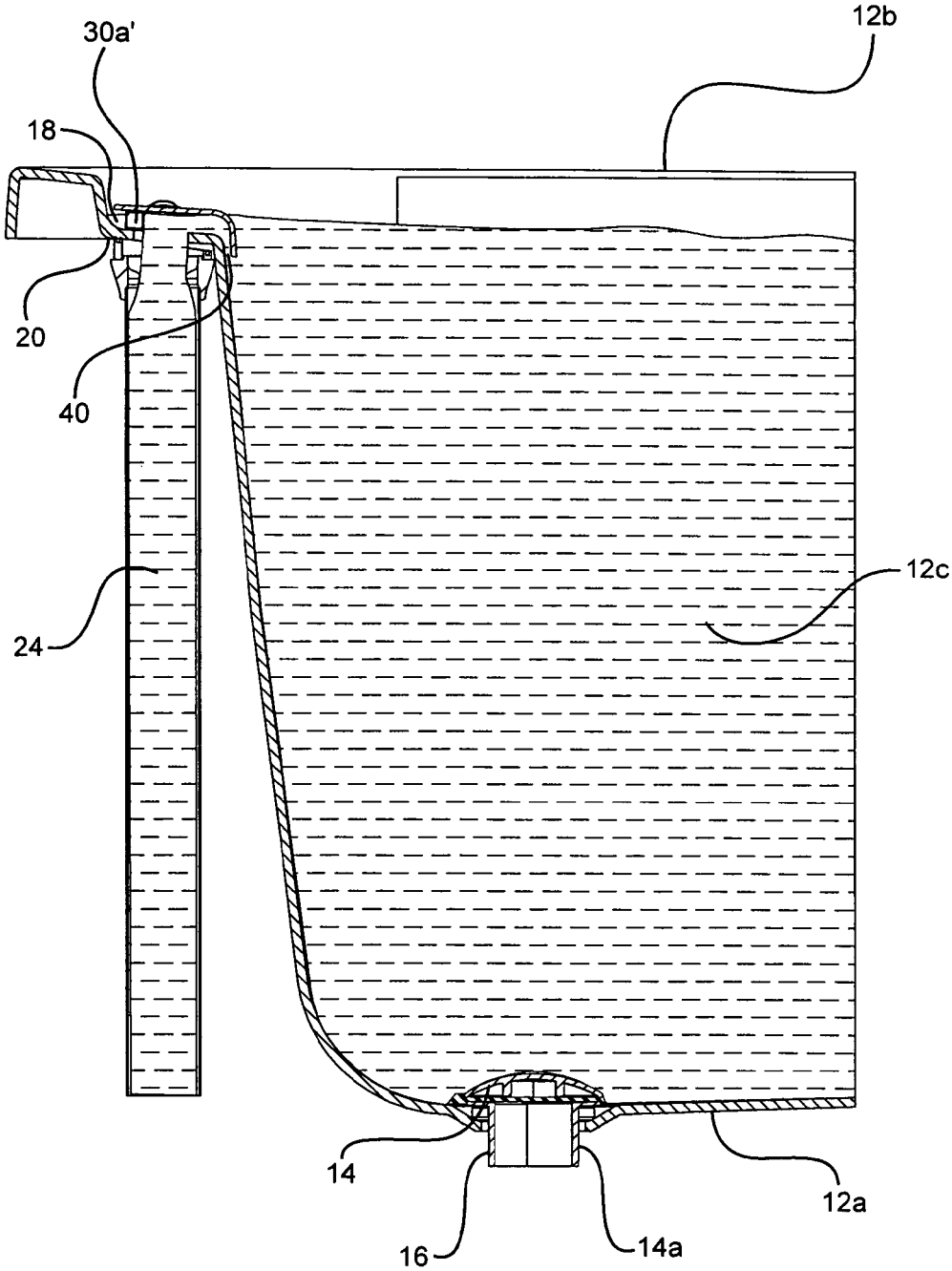
FIG. 5 is a view of the bathing vessel of FIG. 4 during overflow.

Now referring to the figures, wherein like numbers identify like elements, overflow drain assembly 10 is readily installed with a pre-manufactured bathing vessel 12, shown herein as a bathtub. Bathing vessel 12 is depicted as a generally rectangular basin having bottom surface 12*a* and adjacent side surfaces 12*b* depending upwardly therefrom, together delineating a reservoir 12*c* that accepts bathing water and at least one bather during use. A drain 14 provided along bottom surface 12*a* lays adjacent drain port 14*a* that is in fluid communication with a main drain pipe 16 for delivery of water and effluents from vessel 12 to an external sanitary conduit (see FIGS. 4 and 5). Such delivery of water and effluents from vessel 12 through a drain pipe is well known in the industry and forms no part of the present invention.

It is understood that vessel 12 is not limited to the bathtub shown herein and may be any type of bathing vessel (whirlpool tub, stationary tub, etc.) or other sanitary vessel (sink, etc.) as is well known in the industry. It is further understood that, although vessel 12 is depicted in a generally rectangular configuration, vessel 12 may assume any geometry or aesthetic element that is amenable to practice of the present invention and which is established for use in the industry.

Vessel 12 desirably includes ledge 18 defined along at least a portion of at least one side surface 12*b*. Ledge 18 may be generally normal to at least one side surface 12*b* or may depend therefrom at any angle that is conducive to the practice of the present invention. Ledge 18 includes at least one waste overflow port 20 that overlies adjacent opening 22 of waste overflow pipe 24 (see FIGS. 4 and 5). Said at least one waste overflow port 20 is shown herein as a plurality of generally circular apertures 20*a* but may alternatively assume a solitary ellipse or other geometry that facilitates sufficient egress of bathing water and effluents from reservoir 12*c*. Opening 22 and said at least one waste overflow port 20 are desirably disposed in generally horizontal fashion relative to a vessel side surface 12*b* so as to enable direct access to waste overflow pipe 24 for simple installation and maintenance.

Figure 1:
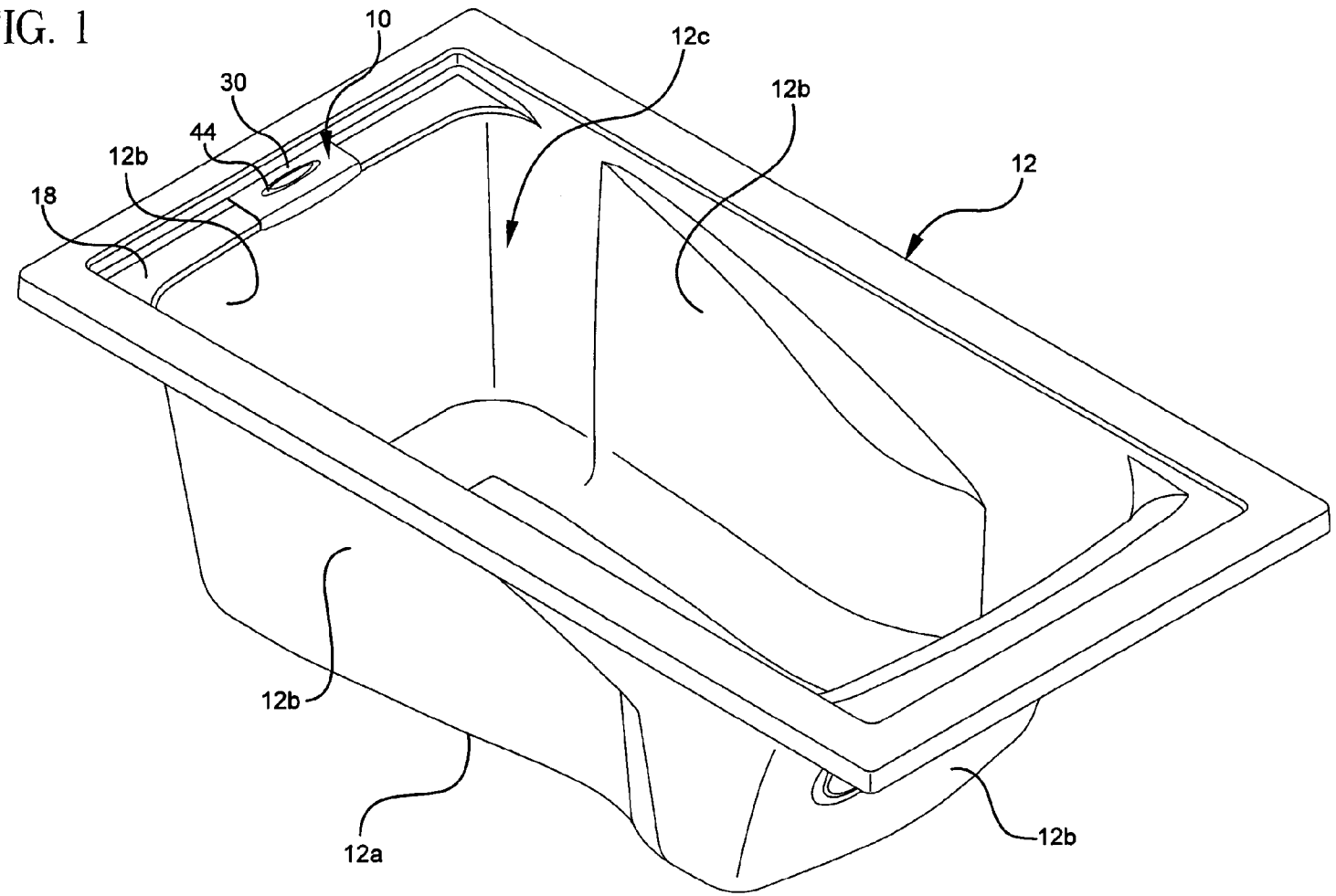
FIG. 1 shows a top perspective view of a bathing vessel that incorporates an overflow drain assembly of the present invention.
Figure 2:
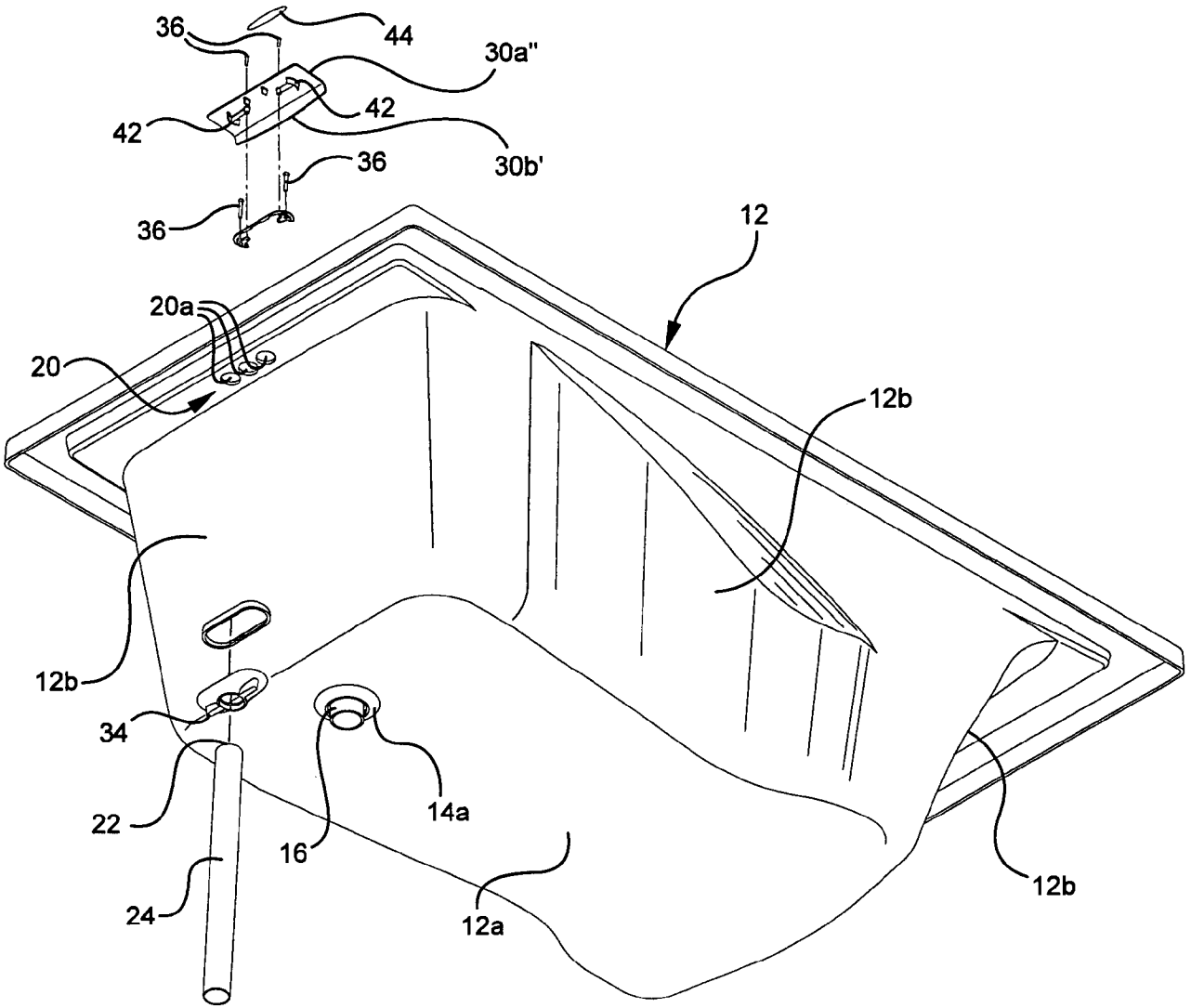
FIG. 2 is a bottom perspective view of the bathing vessel of FIG. 1 with an exploded view of the present invention overflow drain assembly.
Figure 3:
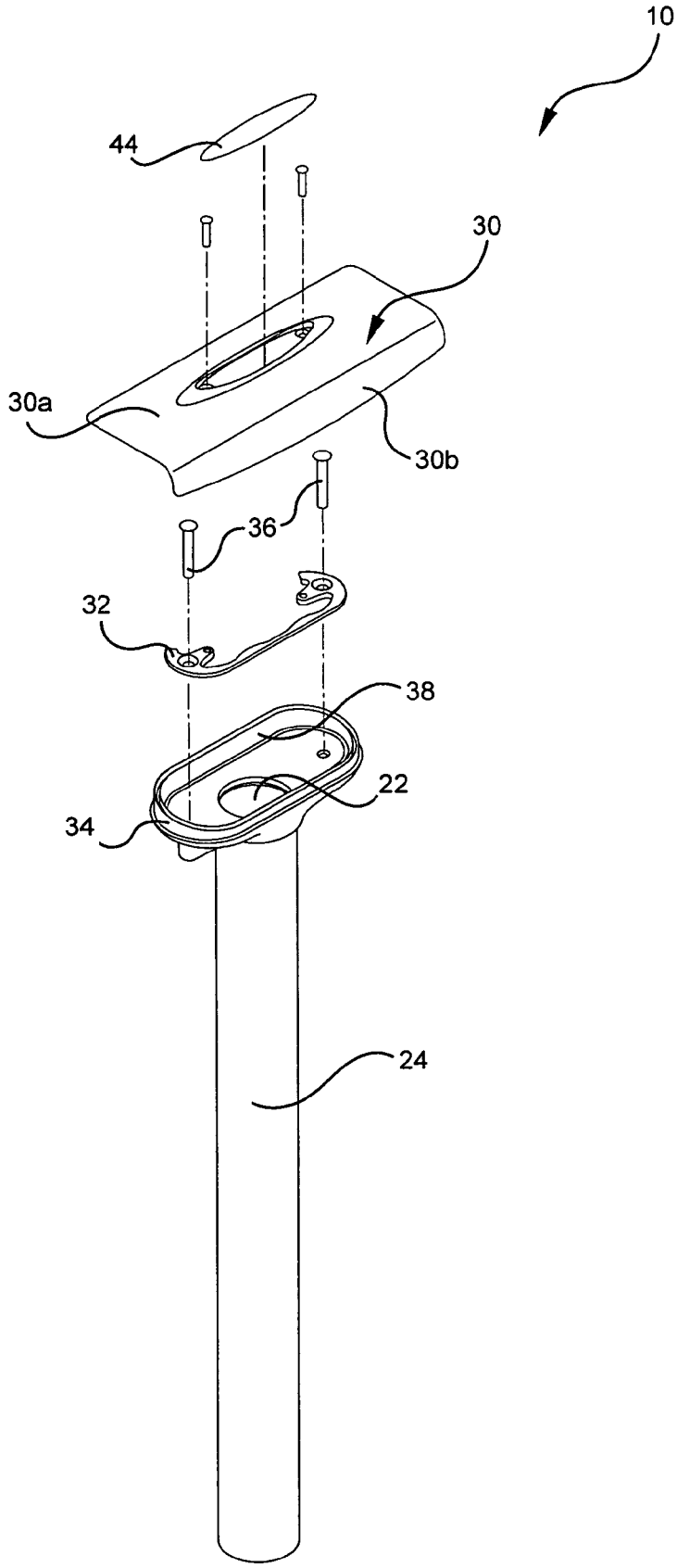
FIG. 3 is an exploded view of the overflow drain assembly of the present invention.

Now referring to FIG. 3, overflow drain assembly 10 includes fastening plate 30 in combination with retainer 32, port adapter 34 and one or more fasteners 36 that detachably couple said elements to one another and to waste overflow pipe 24. It is well understood that securement of drain assembly 10 to vessel 12 may be effected by any means established in the industry as providing sufficient retention and is not limited to fasteners 36 shown herein. Waste overflow pipe 24 may include a sealing member such as gasket 38 shown herein to provide drain assembly 10 with enhanced sealing capability.

Fastening plate 30 includes envelope 30*a* that lies generally planar relative to ledge 18 so as to conceal said at least one waste overflow port 20 and tarp portion 30*b* depending curvilinearly therefrom. Tarp portion 30*b* includes a bottom surface 30*b*' that, together with a portion of vessel side surface 12*b* there adjacent, defines a fluid egress 40 from reservoir 12*c* for. delivery of used bath water and effluents to waste overflow pipe 24. Envelope 30*a* has a top surface 30*a*' and an opposing bottom surface 30*a*" from which one or more platform members 42 depend downwardly so as to elevate envelope 30*a* relative to ledge 18. Either or both of envelope 30*a* and tarp 30*b* of fastening plate 30 may be permanently or detachably affixed to ledge 18 to accommodate the user's desire to vary the aesthetic effect of vessel 12 in a simple and inexpensive manner. To achieve this benefit, envelope top surface 30*a*' may selectively support index element 44 thereon or alternatively feature an indicator integral therewith. Either index element 44 or an integral indicator provides a tactile and/or visual indicator of the location of said at least one waste overflow port 20 relative to fastening plate 30. The present invention thereby increases the available selection of aesthetic and functional combinations in sanitary devices and further empowers the consumer to customize performance and visual appeal at any desired future intervals.

In use, a bather fills vessel reservoir 12*c* with bath water and sits therewithin. To prevent overflow from vessel 12, excess bath water and effluents depart vessel 12 via fluid egress 40. Fluid egress 40 delivers the excess water to said at least one waste overflow port 20 for disposal through opening 22 of waste overflow pipe 24. To clear collected debris or otherwise service drain assembly 10, the user merely removes fastening plate 30 from ledge 18 to access waste overflow pipe from directly thereabove. The present invention thereby inherently accommodates an ergonomically desirable position for installation and maintenance.

Horizontal placement of said at least one waste overflow port 20 along ledge 18 eliminates the problems inherent in vertical placement of conventional overflow drain assemblies, such as overabundant water consumption and substantial temporal and fiscal investments toward installation and maintenance investments of vessel 12. Conventional overflow drain assemblies promote wasteful water consumption by allowing the egress of bath water prior to establishment of a comfortable soaking water level, thereby encouraging the bather to refill the tub and obstruct egress of the overflow fluid. Drain assembly 10, however, establishes a desirably deep soaking level at the onset of a bathing session and simultaneously prevents unwanted overflow. This configuration advantageously obviates the bather's need to continually add more water as used water escapes reservoir 12*c*.

Overflow drain assembly 10 may further include a receptacle defined in fastening plate 30 wherein the receptacle effectively guides fluids therefrom to waste overflow pipe 24. Such an embodiment addresses the significant disadvantage associated with placement of a bath toy, accessory, cleaning apparatus and/or composition in or adjacent vessel 12, that is, runoff of the composition and fluids from the item into the vessel, particularly during use by a bather or shortly therebefore. Direct flow of fluids and residue undesirably contaminates clean bath water and exposed skin. Incorporation of a receptacle in combination with drain assembly 10 realizes optimum cleanliness in existing plumbing structures with minimal fiscal and temporal expenditures.

What is claimed is:

1. An overflow drain assembly for a sanitary vessel, wherein said vessel includes a bottom surface and at least one side surface depending therefrom, said surfaces together defining a reservoir thereby, and at least one ledge defined along at least a portion of at least one said side surface, said overflow drain assembly comprising:

a fastening plate having an envelope with a top surface and a bottom surface defining a generally planar body that lies proximate said vessel ledge, and a tarp portion depending curvilinearly from said envelope and having a bottom surface disposed adjacent at least a portion of said at least one vessel side surface so as to define a fluid egress therebetween for delivery of fluid from said vessel reservoir to a waste conduit in fluid communication therewith;

a port adapter that establishes said fluid communication between said vessel reservoir and said waste conduit; and means for retaining said fastening plate to said vessel.

2. The overflow drain assembly of claim 1, wherein said retaining means comprises a retaining member and at least one fastener that detachably couple said fastening plate with one or more of said vessel and said port adapter.

3. The overflow drain assembly of claim 1, wherein at least one platform member depends downwardly from said envelope bottom surface for elevation of said envelope bottom surface relative to said vessel ledge.

4. The overflow drain assembly of claim 1, wherein said envelope top surface includes at least one index defined thereon to indicate a location of said waste conduit relative to said fastening plate, said index being selected from tactile indices and visual indices that indicate proper alignment of said fastening plate relative to waste conduit.

5. A system for preventing fluid overflow from a sanitary vessel, comprising:

a sanitary vessel having a bottom surface and at least one side surface depending therefrom, said surfaces together defining a reservoir for receipt of fluid by said vessel; at least one ledge defined along at least a portion of at least one said side surface; and a drain provided at or near said bottom surface for delivery of fluid from said vessel to a first waste conduit in fluid communication therewith; and an overflow drain assembly having a fastening plate having an envelope with a top surface and a bottom surface defining a generally planar body that lies proximate said vessel ledge, and a tarp portion depending curvilinearly from said envelope and having a bottom surface disposed adjacent at least a portion of said at least one vessel side surface so as to define a fluid egress therebetween for delivery of fluid from said vessel reservoir to a second waste conduit in fluid communication therewith;

a port adapter that establishes said fluid communication between said vessel reservoir and said second waste conduit; and means for retaining said fastening plate to said vessel.

6. The overflow prevention system of claim 5, wherein said vessel ledge is generally normal to said at least one side surface.

7. The overflow prevention system of claim 5, wherein said vessel ledge includes at least one waste overflow port that overlies an opening of said second conduit.

8. The overflow prevention system of claim 7, wherein said at least one waste overflow port and said second conduit opening are disposed generally horizontally relative to said at least one vessel side surface.

9. The overflow prevention system of claim 5, wherein said fastening plate includes a receptacle in fluid communication with said second waste conduit.

* * * * *